US009706812B2

(12) United States Patent
Hyde et al.

(10) Patent No.: US 9,706,812 B2
(45) Date of Patent: Jul. 18, 2017

(54) FOOTWEAR LACING SYSTEM AND RELATED METHODS

(71) Applicant: Wolverine World Wide, Inc., Rockford, MI (US)

(72) Inventors: Paula E. Hyde, Sudbury, MA (US); Layla Hassoun, Somerville, MA (US)

(73) Assignee: Saucony, Inc., Waltham, MA (US)

( * ) Notice: Subject to any disclaimer, the term of this patent is extended or adjusted under 35 U.S.C. 154(b) by 99 days.

(21) Appl. No.: 14/844,557

(22) Filed: Sep. 3, 2015

(65) Prior Publication Data

US 2017/0065027 A1 Mar. 9, 2017

(51) Int. Cl.

| | |
|---|---|
| ***A43C 1/00*** | (2006.01) |
| ***A43C 1/04*** | (2006.01) |
| ***A43C 5/00*** | (2006.01) |
| ***A43B 23/26*** | (2006.01) |

(52) U.S. Cl.

CPC ..... *A43C 1/04* (2013.01); *A43B 23/26* (2013.01); *A43C 1/006* (2013.01); *A43C 5/00* (2013.01)

(58) Field of Classification Search

CPC .. A43C 1/00; A43C 1/006; A43C 1/04; A43C 5/00

USPC ..... 36/50.1, 52

See application file for complete search history.

(56) References Cited

U.S. PATENT DOCUMENTS 1,981,087 A * 11/1934 Brent ..... A43C 5/00 24/715
3,333,304 A * 8/1967 Daddona, Jr. ..... A43C 5/00 24/715.2
3,703,775 A * 11/1972 Gatti ..... A43B 5/025 36/128
4,551,929 A * 11/1985 Paris ..... A43B 3/14 12/142 MC
5,109,581 A * 5/1992 Gould ..... A43C 5/00 24/712.1
5,943,793 A 8/1999 Clements
6,052,921 A * 4/2000 Oreck ..... A43C 1/00 36/50.1
6,088,936 A * 7/2000 Bahl ..... A43B 7/20 36/50.1
6,202,953 B1 3/2001 Hammerslag
(Continued)

OTHER PUBLICATIONS

Sperry Authentic Original 2-Eye Boat Shoe, downloaded from http://www.sperry.com/en/authentic-original-2-eye-boat-shoe/10118M.html?ref=classic&dwvar_10118M_color=0195115#q=classic&start=1 on Aug. 7, 2015.

(Continued)

*Primary Examiner* — Sharon M Prange

(74) *Attorney, Agent, or Firm* — Warner Norcross & Judd LLP

(57) ABSTRACT

An article of footwear including a 360° lacing system configured to secure the footwear to a wearer's foot. The lacing system includes an elongated lace that extends rearward adjacent an ankle collar, around a heel of the footwear, and forward again. The lacing system includes one or more fairleads that project outwardly from the ankle collar. The fairleads define fairlead holes through which the lace is extends. The lace is slidable relative to the holes, and thus the fairleads, and can be removed from and replaced relative to the fairleads with minimal effort. A related method of utilizing the article of footwear is also provided.

18 Claims, 7 Drawing Sheets

(56) References Cited

U.S. PATENT DOCUMENTS

| | | | | |
|---|---|---|---|---|
| 6,240,657 | B1 * | 6/2001 | Weber | A43B 1/0072 24/714.8 |
| 6,502,329 | B1 * | 1/2003 | Silagy | A43C 3/00 24/713.4 |
| 7,370,440 | B1 * | 5/2008 | Cole, III | A43B 5/003 36/50.1 |
| 7,503,130 | B2 * | 3/2009 | Helton | A43B 5/08 36/3 B |
| 7,631,440 | B2 * | 12/2009 | Keen | A43B 1/14 36/50.1 |
| 9,474,330 | B2 * | 10/2016 | Panian | A43C 1/006 |

OTHER PUBLICATIONS

Sperry Authentic Original Cyclone Leather 2-Eye Boat Shoe, downloaded from http://www.sperry.com/en/authentic-original-cyclone-leather-2-eye-boat-shoe/10137M.html?ref=cyclone%20leather&dwvar__10137M__color=STS10585#q=cyclone+leather&start=1 on Aug. 7, 2015.

* cited by examiner

FOOTWEAR LACING SYSTEM AND RELATED METHODS

BACKGROUND OF THE INVENTION

The present invention relates to footwear, and more particularly, to lacing systems for use with footwear to secure the same to a wearer's foot.

There is a variety of footwear used for different purposes. Some footwear includes unique lacing systems that provide certain aesthetics and/or functional attributes. One type of footwear lacing system features a lace that wraps from the front of the footwear, travels around a heel of the footwear, and extends again toward the front of the footwear. This conventional lace, however, is inserted between the upper and the lining of the footwear. Much of the lace is itself concealed within and hidden by an outer layer of the upper. Generally, the concealed lace extends below the surface of material designed to form an ankle collar around an ankle opening of the shoe.

While the above conventional lacing system can satisfactorily ensure that the associated footwear remains on the foot of a user, it presents some issues. Specifically, because the lace extends below the upper, and partially through an ankle collar interior, as it wraps around the rear of the heel, it is very difficult to replace that lace or customize that lace. For example, special tools must be used to pry and/or pull the lace under the upper material to an accessible position and/or to otherwise remove the lace. This can cause frustration to anyone desiring to replace a broken lace and/or customize their footwear with a different aesthetic lace.

Accordingly, their remains room for improvement in connection with functional lacing systems for footwear.

SUMMARY OF THE INVENTION

An article of footwear is provided including a 360° lacing system configured to secure the footwear to a wearer's foot. The lacing system includes an elongated lace that extends rearward adjacent an ankle collar, around a heel of the footwear, and forward again. The lacing system includes one or more fairleads that project outwardly from the ankle collar. The fairleads define fairlead holes through which the lace extends and is guided around the ankle collar. The lace is slidable relative to the holes, and thus the fairleads, and can be removed from and replaced relative to the fairleads with minimal effort. This provides a user with a functional 360° lacing system having a lace that can be easily removed and/or replaced.

In one embodiment, the footwear includes an upper having an ankle collar and a tongue cooperatively surrounding an ankle of a wearer when the footwear is worn by the wearer. The ankle collar includes an ankle collar rear portion extending around a heel of the wearer when the footwear is worn by a wearer.

In another embodiment, the upper includes at least one fairlead extending outwardly from the ankle collar. The fairlead can include a first base that engages the ankle collar, a body and an optional post. The body can extend outwardly from the base and can define a lace hole. The optional post can extend inwardly through at least a portion of the ankle collar to secure the fairlead to the ankle collar.

In still another embodiment, the at least one fairlead can be located closer to the ankle collar rear portion than the tongue. Where multiple fairleads are included on the ankle collar, some of them, however, may be located closer to the tongue than the ankle collar rear portion.

In yet another embodiment, the upper includes an elongated lace including first and second ends. The elongated lace extends from near the tongue, rearward adjacent the ankle collar. The lace extends through a first fairlead lace hole, and around the heel of the wearer. The lace extends through a second fairlead lace hole back toward the tongue. Optionally, the elongated lace encircles the ankle of the wearer 360°, with the first and second ends joinable at a knot to secure the footwear to the wearer's foot.

In even another embodiment, the elongated lace remains exterior to the ankle collar as the elongated lace extends adjacent the ankle collar.

In a further embodiment, the upper defines a side eyelet, and at least one lace eyelet forward of the side eyelet. The elongated lace extends from a forward fairlead, through the side eyelet, and into an interior of the upper. The lace extends to the lace eyelet in the interior, then out through the lace eyelet to an exterior of the upper. The lace can be laced and crisscrossed over the tongue and tied to secure the footwear. Upon tightening the lace, it snugs around the ankle of the wearer as well to enhance securement to the foot.

In still a further embodiment, a method is provided. The method includes providing footwear with an upper having an ankle collar extending around an ankle opening of the footwear, the ankle collar having attached thereto multiple fairleads defining lace holes; stringing an elongated lace from a first location adjacent the tongue, through a fairlead first lace hole, around the heel of the wearer, through a fairlead second lace hole, back toward a second location adjacent the tongue on an opposite side of the upper; and joining first and second ends of the elongated lace at a knot over the tongue to secure the footwear on the wearer's foot. Optionally, the elongated lace remains entirely exterior to the ankle collar, and the elongated lace encircles the ankle of the wearer 360°. Further optionally, no tools are required to string the elongated lace around the ankle collar and through the fairleads, as this task can be performed manually.

The footwear and related method of the current embodiments provide a simple and functional 360° lacing system. Where the elongated lace is slidably and removably disposed in the fairleads, that lace can easily be replaced when worn, or customized with different textured and/or colored laces depending on the user's preference. Thus, the replacement and servicing of the functional lace in the current footwear is greatly facilitated and simplified.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
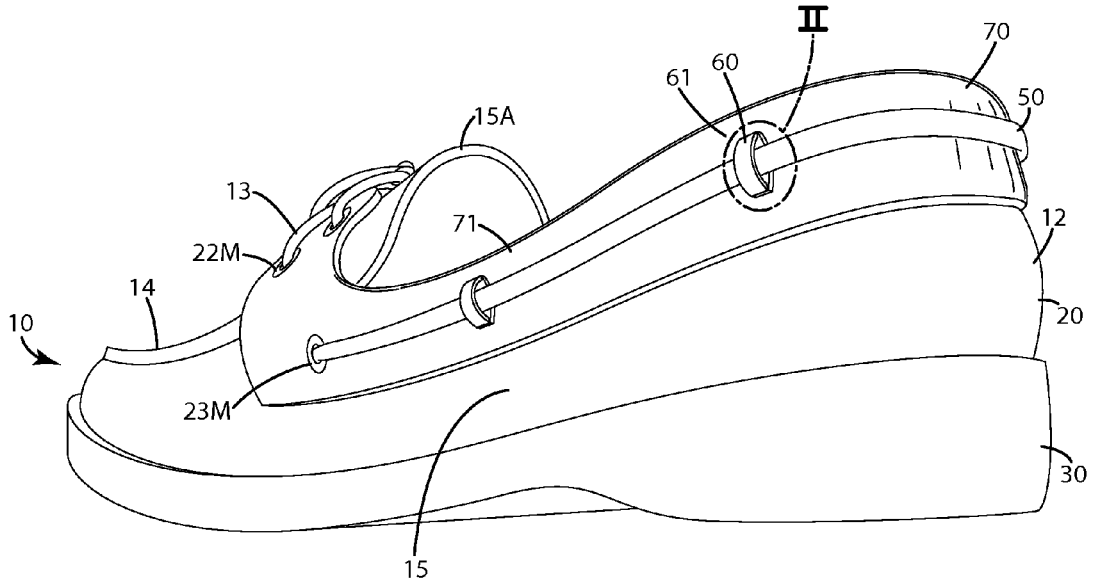
FIG. 1 is a rear perspective view of footwear of the current embodiment illustrating a lacing system having a lace extending through fairleads.
Figure 2:
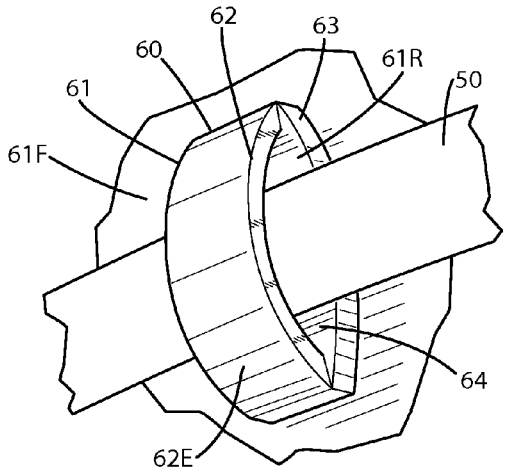
FIG. 2 is a close up view of a fairlead taken from View II of FIG. 1.

An article of footwear in accordance with a current embodiment is shown in FIGS. 1-9 and generally designated 10. The footwear includes an upper 20 that is joined with an outsole 30. The footwear 10 also includes a lacing system 40. The lacing system 40 includes at least one elongated lace 50 and one or more fairleads 60. The elongated lace can be slidably disposed through holes defined by the fairleads, which guide and secure the lace 360° around an ankle opening 11, exterior to the ankle collar 70 of the footwear 10. The elongated lace also can be removable relative to the fairleads without the use of tools, that is, via manual manipulation. This can facilitate replacement of worn lace and/or customization of the lace depending on a user's preference.

Although the current embodiments are illustrated in the context of a casual shoe, they may be incorporated into any type or style of footwear, including working boots, safety shoes, performance shoes, hiking shoes, trail shoes and boots, hiking boots, all-terrain shoes, barefoot running shoes, athletic shoes, running shoes, sneakers, conventional tennis shoes, walking shoes, multisport footwear, dress shoes or any other type of footwear or footwear components. It also should be noted that directional terms, such as "vertical," "horizontal," "top," "bottom," "upper," "lower," "inner," "inwardly," "outer" and "outwardly," are used to assist in describing the invention based on the orientation of the embodiments shown in the illustrations. Further, the terms "medial," "lateral" and "longitudinal" are used in the manner commonly used in connection with footwear. For example, when used in referring to a side of the shoe, the term "medial" refers to the inward side (that is, the side facing the other shoe) and "lateral" refers to the outward side. When used in referring to a direction, the term "longitudinal direction" refers to a direction generally extending along the length of the shoe between toe and heel, and the term "lateral direction" refers to a direction generally extending across the width of the shoe between the medial and lateral sides of the shoe. The use of directional terms should not be interpreted to limit the invention to any specific orientation.

Further, as used herein, the term "arch region" (or arch or midfoot) refers generally to the portion of the footwear or sole assembly corresponding to the arch or midfoot of the wearer's foot; the term "forefoot region" (or forefoot) refers generally to the portion of the footwear forward of the arch region corresponding to the forefoot (for example, including the ball and the toes) of a wearer's foot; and the term "heel region" (or heel) refers generally to that portion of the footwear rearward of the arch region corresponding to the heel of the wearer's foot. The forefoot 17, arch or midfoot 18, and heel 19 regions are generally identified in FIG. 3, however, it is to be understood that delineation of these regions may vary depending upon the configuration of the sole assembly and footwear.

The upper 20 optionally is of a Strobel construction in which the foot-receiving upper interior 21 is closed on its bottom or lowermost portion by a Strobel board, an insole board, sock or liner 22 or other similar component. Although not shown, the footwear 10 can include a footbed and/or other upper components with the footbed fitted into the upper 10.

For purposes of disclosure, the embodiments herein are described in connection with footwear in the form of a casual shoe 10 having an upper 20, which as mentioned above, optionally can include a Strobel construction. The upper 20 is joined with the outsole 30. The joining of the outsole 30 and the upper 20 can be accomplished using adhesives, cement, injection molding, pour molding or any other technique used to join an upper and outsole. As illustrated, the insole board or liner 22 can rest or be placed immediately adjacent the outsole 30.

The outsole 30 can be disposed below the upper 20 and any optional midsole included in the construction. The outsole 30 can be constructed from one or more materials. The current embodiment can be constructed from rubber and can include lugs, tread, or other gripping elements. Alternatively, it can be constructed from a thermoplastic polyurethane elastomer (TPU), nylon or other polymer blend that includes nylon and/or TPU. Of course, the outsole can be constructed from any relatively wear resistant polymer, elastomer and/or natural or synthetic rubber or other materials capable of providing the desired functional characteristics. Other materials such as fiber-reinforced polymers can be used. These can include epoxy, polyethylene, polyester, thermosetting plastic reinforced with carbon, glass and/or aramid fibers.

As illustrated in FIGS. 1-7, the upper 20 can include a toe section 14, which is immediately adjacent a vamp 13. Generally, toe section 14 covers the location of the upper where the toes of the wearer are located. The vamp 13 extends above and instep of the wearer's foot when inserted in the interior 21 of the footwear 10. The vamp may or may not include a tongue 15A is adapted to fit over at least a portion of the instep of the wearer's foot. The tongue can be attached at a first forward and the remainder of the vamp and can include a rear end 15R which generally faces toward the ankle opening 11 of the footwear 10.

Figure 3:
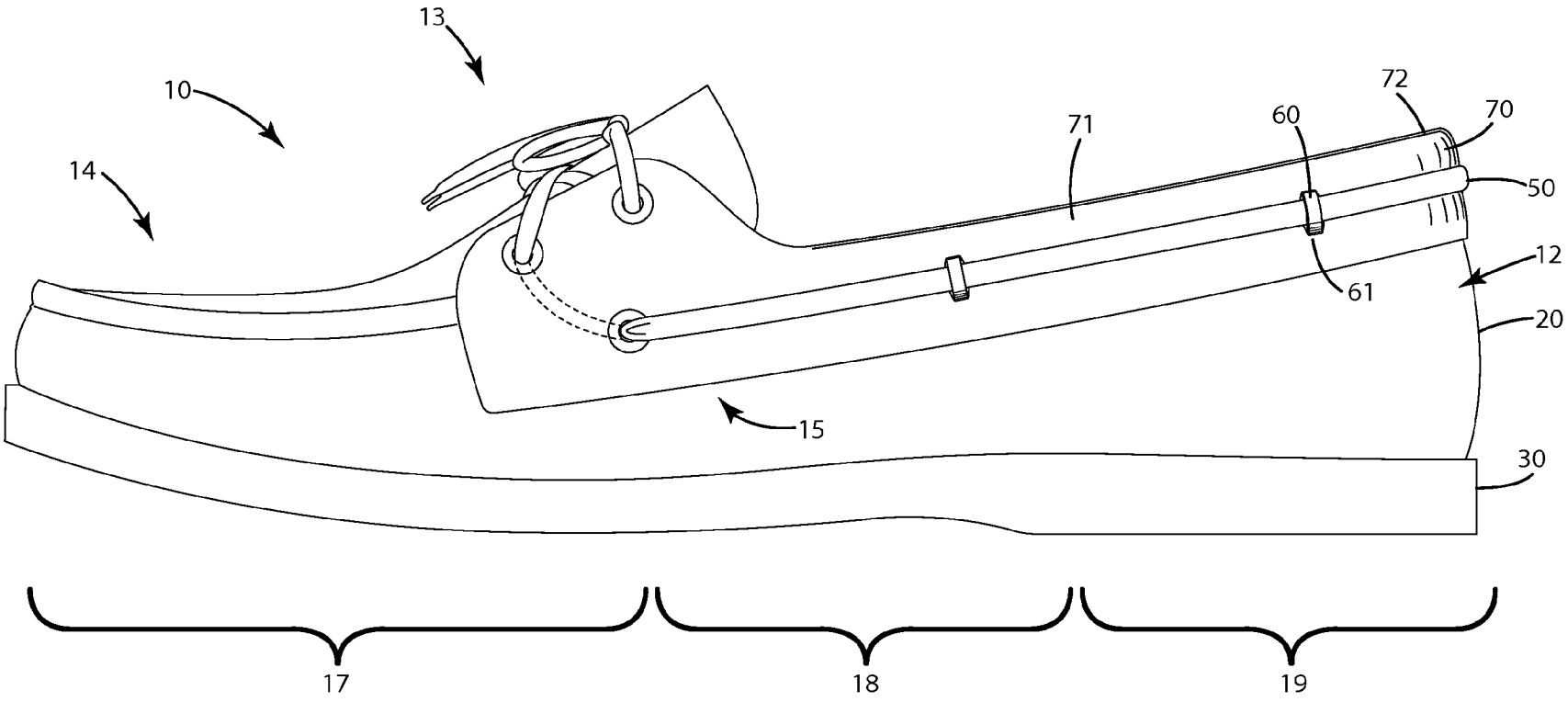
FIG. 3 is a side view of the footwear including the lacing system.
Figure 4:
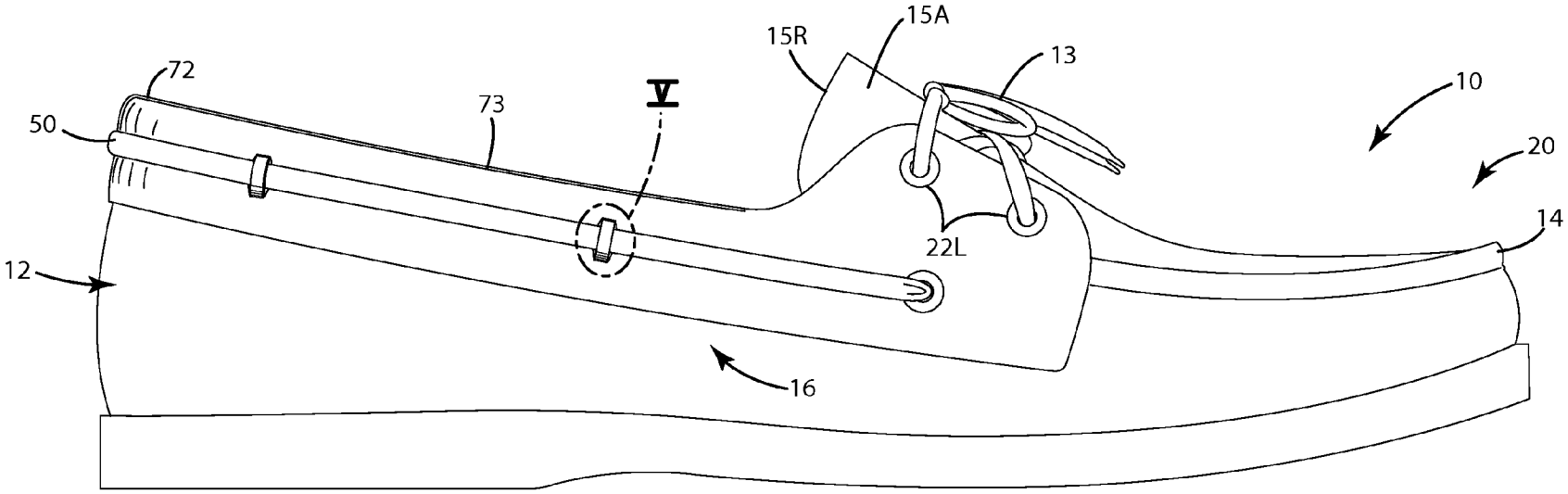
FIG. 4 is another side view of the footwear.

The vamp 13 also can include lateral and medial wings 13L and 13M which extend upwardly over the instep region, optionally extending from the side quarters 15, 16 and/or a forward portion of the ankle collar 70. These wings can include opposing edges 13M1 and 13L1 that generally face toward one another and extend above the tongue 15A. The opposing edges can each define respective lace eyelets 22M and 22L, respectively. These lace eyelets can be in the form of a metal, composite and/or plastic collar that provides a bounded hole through the vamp in that region. Alternatively, the lace eyelets can be simple holes defined through the respective component of the upper through which a lace extends. As illustrated in FIGS. 3-4, the lace eyelets can be disposed above the tongue 15A when the footwear 10 is in a configuration in which the lacing system is operated. The lace eyelets 22M, 22L can provide an aperture from an interior surface of the vamp to an exterior surface of the vamp, allowing the lace to pass between this interior and exterior through the aperture. As illustrated, the lace eyelets can be circular or cylindrical, and structured to facilitate movement and/or sliding of the lace through that structure. Of course other geometric configurations can be selected depending on the application.

As shown in FIGS. 1 and 3, a first side quarter 15 and a second side quarter 16 can be attached, joined and/or integral with the vamp 13. The first side quarter 15 can be located on the medial M side of the longitudinal axis LA of the footwear or upper. The second side quarter 16 can be located on the lateral side L of the longitudinal axis LA. The side quarters can extend from the ankle collar 70 downward to the outsole 30. Additional or other components can be joined with the side quarters to provide the desired aesthetics and/or structure to the footwear 10.

Generally, the side quarters can extend rearward from the vamp 13 toward a heel portion 12 of the upper 20. The heel portion can be formed so that the side quarters and heel portion are integrally formed with one another. In one embodiment, all of these components can be constructed from a single sheet or piece of leather, canvas, fabric or other material. Generally, the heel portion 12 wraps around the heel of the wearer when the wearer's foot is located in the footwear 10. Thus, the heel portion 12 naturally transitions from the medial first side quarter 15 to the lateral second side quarter 16 around the heel of the wearer. Although illustrated as extending from the ankle collar 70 all the way to the outsole 30, in some cases the heel portion 12 can be truncated so that there is an opening adjacent the heel. In addition, certain portions of the side quarters 15, 16 can be deleted or removed so that there are open holes or apertures (not shown) in these components. Likewise the vamp can define one or more holes or apertures (not shown). Generally, these optional holes or apertures can facilitate airflow and/or water expulsion relative to the interior of the footwear.

Figure 7:
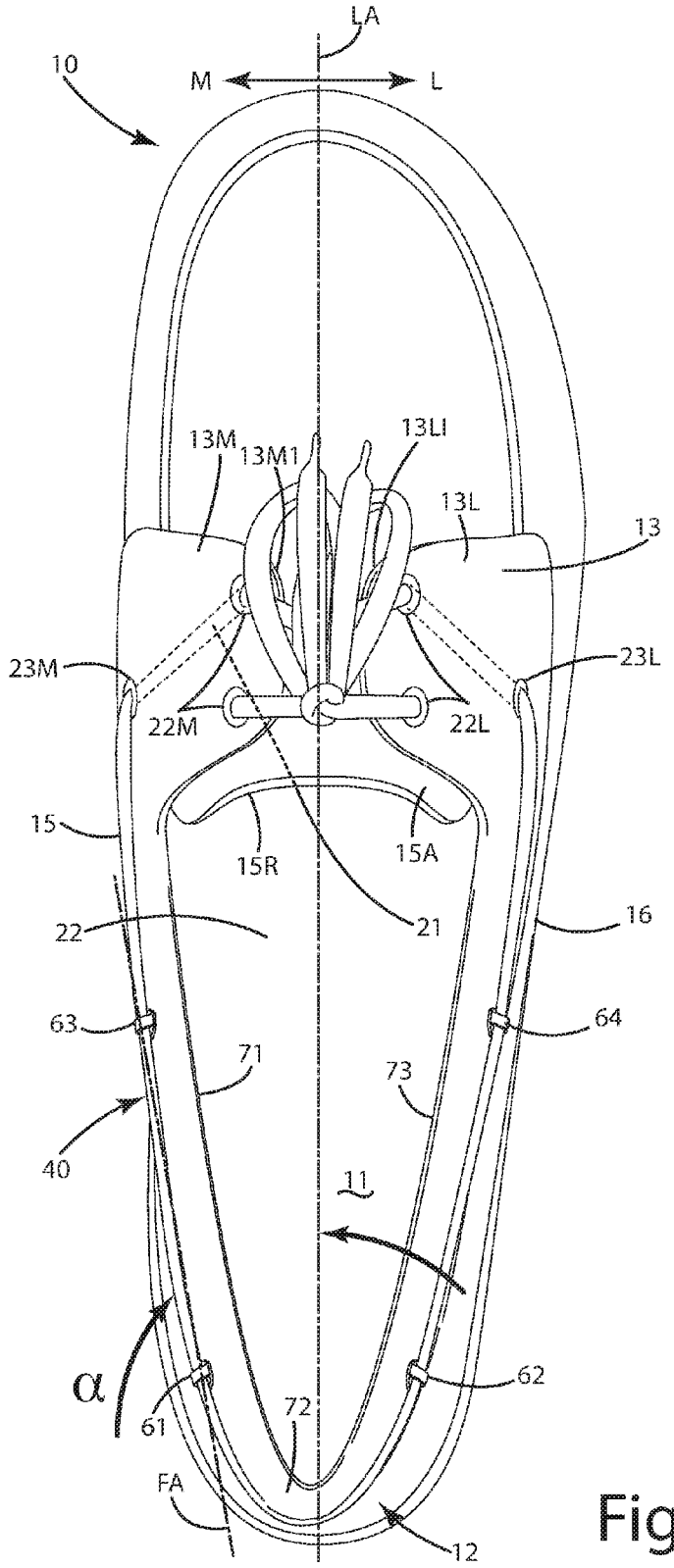
FIG. 7 is a top view of the lacing system installed in the footwear.
Figure 8:
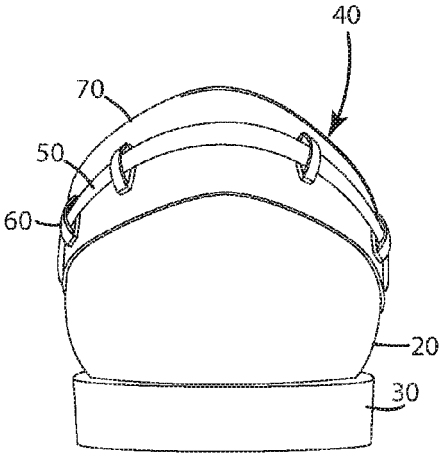
FIG. 8 is a rear view of the lacing system installed in the footwear.

As illustrated in FIGS. 1, 3 and 7, the vamp and/or side quarters, and/or optionally the ankle collar 70 can define one or more side eyelets 23M and 23L respectively on the medial M and lateral L sides of the longitudinal axis LA. The side eyelets can extend from an exterior of the footwear to and interior 21 of the footwear 10 or upper 20. The side eyelets can be in the form of a metal, composite and/or polymeric structure, similar to the lace eyelets 22M and 22L described above.

The upper 20 can include an ankle collar 70 as described above and shown in FIGS. 1, 3 and 7. The ankle collar can extend generally from the tongue and/or vamp rearward above the side quarters, around the heel portion 12. The ankle collar can connect the lateral and medial sides of the footwear. Cooperatively, the ankle collar 70 and tongue 15A, in particular the rear edge 15R of the tongue, can encircle the ankle of the wearer 360°. These components also can define the ankle collar opening 11 in which the ankle, lower calf and/or lower leg of a wearer is disposed when the footwear is placed on a wearer's foot.

The ankle collar 70 can include an ankle collar first side 71 that extends away from the vamp, generally above the first side quarter 15 on the medial side M of the longitudinal axis LA. The ankle collar can transition rearward to an ankle collar rear portion 72 that is disposed generally above the heel portion 12 of the upper. Here, the ankle collar rear portion 72 can also traverse the longitudinal axis LA rearward of the heel of the wearer. The ankle collar rear portion as illustrated can be of an arcuate and/or parabolic shape to comfortably engage the rear of a wearer's heel, adjacent an Achilles tendon of the wearer. Although not shown, additional padding can be disposed in this region to provide cushion.

The ankle collar rear portion 72 can transition to the ankle collar second side 73. This ankle collar second side 73 can extend toward and away from the vamp, generally connecting the ankle collar rear portion with the vamp. The ankle collar second side 73 also can extend above the second side quarter 16 on the lateral side L the longitudinal axis LA. Cooperatively, the ankle collar second side 73, ankle collar heel rear portion 72 and ankle collar first side can be joined with one another to form the ankle collar 70. This ankle collar 70 and the tongue 15A can cooperatively surround an ankle of the wearer when the footwear is worn by the wearer.

Figure 6:
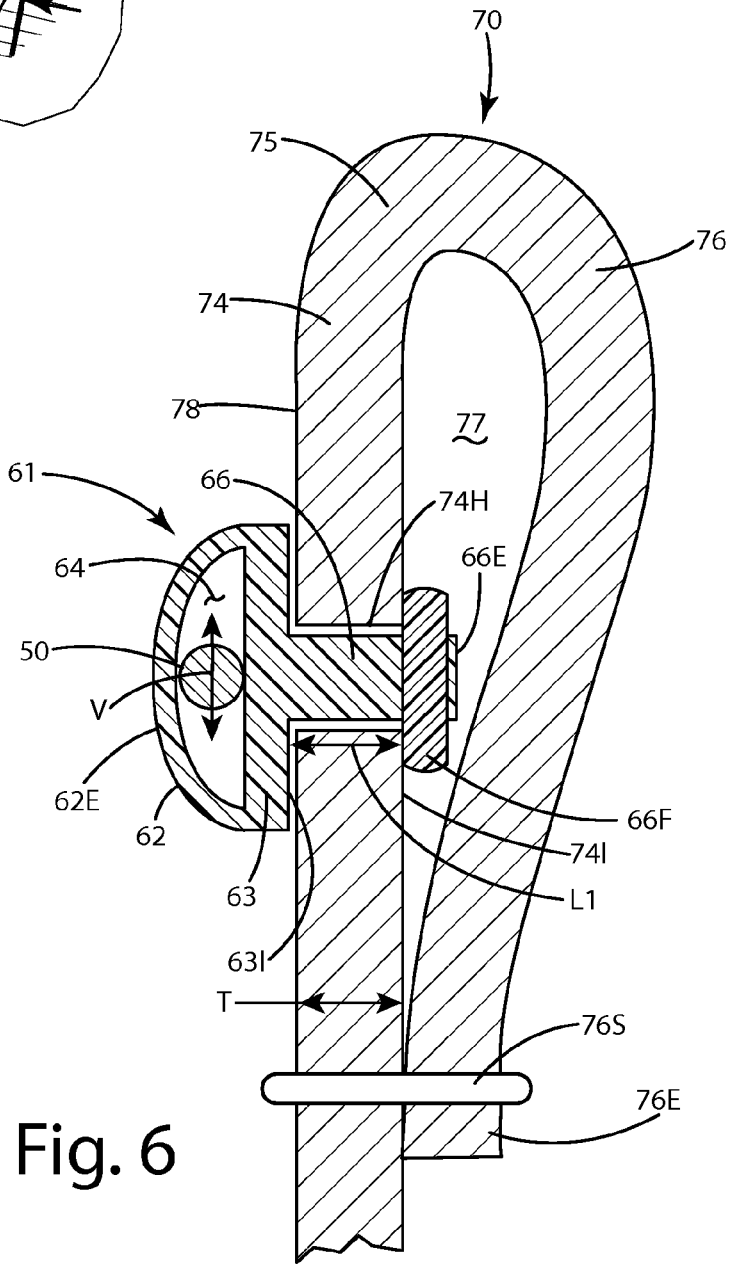
FIG. 6 is a sectional view of an ankle collar and the fairlead, taken along line VI-VI of FIG. 5.

As shown in FIG. 6, the ankle collar 70 optionally can be constructed from one or more sheets of material. In particular, the ankle collar can include an exterior or first portion 74 of a sheet of material that extends upward toward an uppermost part of the ankle color. The first portion 74 can be optionally folded over upon itself at a fold 75. The fold optionally can transition to a second portion 76 of a sheet of material, which can extend back downward from the fold line 75. Of course, the fold 75 can be deleted from the construction, with the first portion 74 simply stitched, adhered or otherwise secured to the second portion 76, and with both portions being separate independent sheets or pieces of material.

Generally, the second portion of the sheet faces the interior of the ankle collar opening 11. The first portion 74 faces exteriorly or outward, away from the ankle collar opening 11. The second portion 76 extends to an end 76E. This end can be stitched directly to the first portion 74 with stitching 76S. In other cases, this end 76E can be glued, fastened, riveted or otherwise connected to the first portion 74. In yet other constructions, the end 76E may be constructed to join with an intermediate component, such as another layer or sheet disposed adjacent the exterior portion, the side quarter, or other component of the footwear.

Optionally, as shown in FIG. 6, the first portion 74 and the second portion 76 form an ankle collar cavity 77 therebetween. This cavity can be hollow, or optionally, a cushion material, such as foam or a pad, can be placed within the cavity to provide extra padding or cushion around the ankle collar 70 of the footwear. As illustrated, the interior ankle collar cavity 77 can be a relatively small compartment cavity or hollow space. In other constructions however, where it the second portion 76 extends downward, closer to the outsole, this cavity can be much larger in volume.

The footwear 10, and in particular its lacing system, includes one or more fairleads 60 that are disposed adjacent the ankle collar opening 11, and optionally join directly with an exterior facing surface 78 of the ankle collar 70. With reference to FIGS. 1, 3, 7 and 8, the ankle collar 70 can include multiple fairleads 60. The fairleads can include a first fairlead 61, which can be replicated to form the other fairleads. The fairlead 61 extends outwardly from the ankle collar 70 above the first side quarter 15 and/or the heel portion 12 of the upper. The first fairlead 61 can be disposed on the medial side M of the longitudinal axis LA. The first fairlead 61 can be mirrored by a second fairlead 62 disposed on the lateral side L of the longitudinal axis, directly across from or opposite the first fairlead 61. The second fairlead can extend outwardly from ankle collar 70 above the second side quarter 16 on this lateral side.

Generally, the first 61 and second 62 fairleads can be located the same distance rearward from the rear edge 15R of the tongue, and the same distance forward from the ankle collar rear portion 72. Of course, in certain applications the distances of each of the fairleads can be varied and/or staggered or offset relative to one another. Optionally, the first and second fairleads 61, 62 can be located closer to the ankle collar rear portion 72 and/or the heel portion 12 of the upper 20 than to the rear edge 15R or the tongue 15A.

The number of fairleads can vary depending on the particular application and desired aesthetic of the footwear. Optionally, as shown in FIGS. 1 and 7, third 63 and forth 64 fairleads can be disposed on the ankle collar 70, and in particular the ankle collar first side 71 and ankle collar second side 73 respectively. These additional fairleads can be located closer to the tongue 15A and/or rear edge 15R of the tongue than to the ankle collar rear portion 72 and/or heel portion 12 of the upper 20.

When multiple fairleads are utilized on a same side of the longitudinal axis LA, they can be aligned along a common fairlead axis FA. As shown in FIG. 7 the common fairlead axis FA extends generally from the first fairlead 61 to the third fairlead 63, both located on the medial side M of the longitudinal axis LA, on the ankle collar exterior. With this alignment of the fairleads, a lace 50 positioned through the respective fairleads can be aligned in a substantially straight line from one fairlead to the next. There may however be an outward bowing of the lace 50 away from the longitudinal axis LA, such that the fairleads are aligned along a slight curve or arc.

The fairleads themselves can define fairlead lace holes 64. The fairlead lace holes of fairleads disposed on the same lateral or medial side of the longitudinal axis can themselves include fairlead lace hole axes that are substantially aligned with one another along the common fairlead axis FA. Of course, with some footwear, those fairlead lace hole axes might be slightly offset relative to one another and/or the common fairlead axis by optionally 1° to 10°, further optionally 2° to 5°, depending on the curvature of the ankle collar from one fairlead to the next or other features of the footwear.

Optionally, the fairlead lace hole axes can be aligned so that they are approximately parallel to the longitudinal axis LA of the footwear. By approximately parallel, it is meant that the fairlead hole axes align so that they are optionally parallel to the longitudinal axis, and/or further optionally offset relative to the longitudinal axis LA at an angle $\alpha$ which can be 1° to 25°, and/or 1° to 10°. This can contrast the eyelet axes EA shown in FIG. 9, which are generally disposed at an angle relative to the longitudinal axis LA. In some cases the eyelet axes, for example, of the side eyelets 23M, 23L are disposed almost perpendicular to the longitudinal axis LA.

The fairleads can be specifically configured to slidably restrain the lace 50 around the ankle collar and the ankle opening in general, without the lace extending into an interior portion 21 of the upper and adjacent or around the ankle collar 70. The lace 50 is retained and held in place entirely exterior to the ankle collar 70 and its respective ankle collar portions, for example the ankle collar first side, the ankle collar rear portion in the ankle collar second side, as well as outside the ankle collar cavity.

The lace 50, however, can optionally extend into an interior 21 of the upper 20 somewhat forward of the ankle opening or generally forward of a rear edge 15R of the tongue 15A. As an example, the lace 50 can extend through one or more side eyelets 23M, 23L and into the interior 21 of the upper 20, forward of the ankle collar 70.

Returning to the construction of the fairleads 60, they may take on a variety of forms. As illustrated in FIGS. 1-6, the first fairlead 61 can include a forward facing surface 61F and rearward facing surface 61R. The forward facing surface 61F can include multiple facets which face generally toward the toe section 14 of the footwear 10. The rear surface 61R also can include multiple facets that extend rearward and face rearward toward the heel portion 12 of the upper 20.

The fairlead 61 can include a fairlead body 62 that extends outward from a base 63. The body 62 of the fairlead 61 can include an exterior surface 62E that faces outward, away from the ankle collar opening in the ankle collar in general. This exterior surface of the fairlead, as well as the body, can transition to the base 63. The fairlead body 62 can define a fairlead lace hole 64, which optionally can be completely circumferentiated aided by the base and/or body. In such a construction, the lace hole, and thus the body and/or base can completely circumferentiate the lace through the lace hole. Of course, in some cases, only partial circumferentiation is desired. This fairlead lace hole 64 extends completely through the fairlead, generally from the fairlead rearward surface 61F to the fairlead rear surface 61R.

As illustrated in FIG. 6, the hole 64 can generally be in the form of an open arch having a flat bottom adjacent the base 63. Of course, other geometric configurations for the hole 64 can be selected. In some cases, the hole can be a circular hole, such as the circular hole 64' shown in FIG. 10. In other cases, the hole can be polygonal, triangular, rectangular, elliptical or of other shapes. As shown in FIG. 6, the arcuate hole 64 can provide and/or facilitate some vertical V movement within it for the lace 50. This in turn allows the lace to shift depending on the tension in the lace. Where the hole is larger than the lace, the lace can move around somewhat within the hole as the wearer moves.

Figure 5:
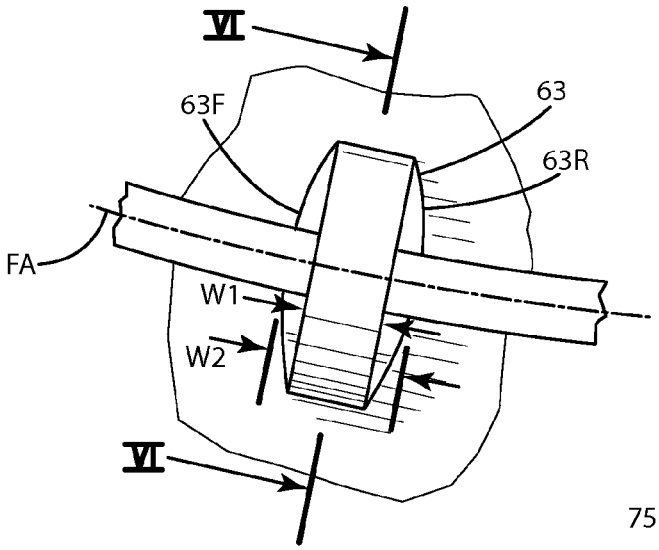
FIG. 5 is another close up view of a fairlead taken from View V of FIG. 4.

As shown in FIG. 5, the fairlead base 63 can include forward and rearward protuberances that extend forwardly and rearwardly therefrom. The front protuberance 63F and rear protuberance 63R can be in the form of an arcuate shape. The protuberances can form the base 63 so that it has a greater width W2 relative to the width W1 of the fairlead body 62. Of course, these widths of the base and the body can be equal or can be reversed. In some cases, where the base is wider than the body, this can provide an additional seating surface for the lace, while still satisfactorily straining the lace within the fairlead hole.

As shown in FIG. 6, the base 63 includes an interior surface 63I. This interior surface 63I faces toward and generally engages directly against an exterior surface 78 of the first portion or exterior portion 74 of the ankle collar 70. The interior surface can generally be flat, convex or concave depending on the particular application. Further, if desired, there can be sharp projections or tabs extending from the interior surface 63I to assist in anchoring the fairlead and in particular the base to the ankle collar 70, for example the sheet 74.

As shown in FIG. 6, the fairlead 61 optionally can include a fairlead post 66. The fairlead post 66 can extend from the base 63 in a direction opposite the body 62. This post can be centered relative to the upper and lowermost extremities of the base 63. Of course, in certain applications it can be offset. The post 66 can be of a circular, square, polygonal, elliptical or other desired geometric shape in cross section, depending on its structural characteristics and function. The post 66 can be of a length L1. This length generally can be greater than the thickness T of the exterior portion 74 of the ankle collar. Accordingly, a portion of the post, and more particularly, an end 66E can project beyond the interior surface 741 of the first portion 74. The post 66 also can be sized and shaped to project through a hole or aperture 74H defined by the sheet 74. If desired, the end 66E can be sharpened so that it can puncture the first portion 74 when installed thereon. The post 66, and in particular the end 66E, can project into the ankle collar interior cavity 77 as shown in FIG. 6. The post 66, and in particular the end 66E can be joined with a fastener 66F that secures the post and the fairlead 61 to the ankle collar 70. This post and fastener can be in the form of a rivet.

Alternatively, the fairlead, its post and/or fastener can be adhered, hot welded, stitched, or otherwise joined with the first portion or ankle collar in general. In other constructions, the base 63 can be adhered, hot welded, stitched (in which case, there can be stitch holes in the base), or otherwise joined, along its interior 63I to the exterior 78 the ankle collar 70.

Figure 10:
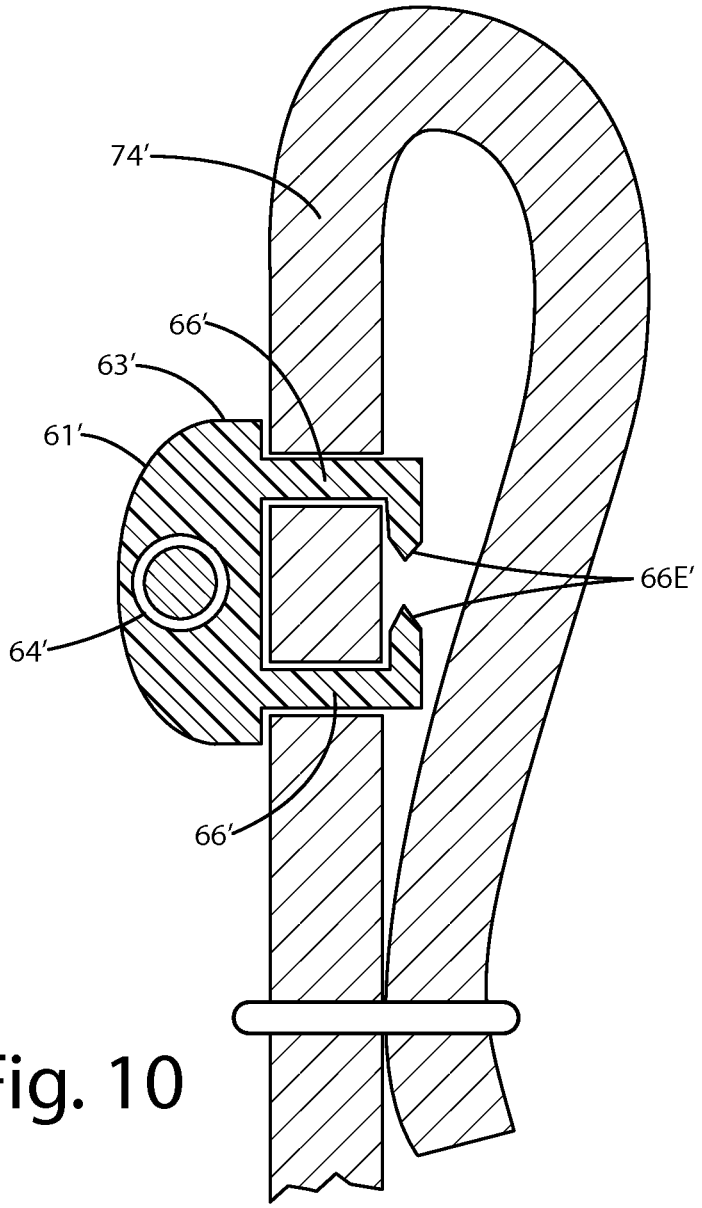
FIG. 10 is a sectional view of an alternative construction of a fairlead joined with an ankle collar.

An alternative construction of the fairlead is illustrated in FIG. 10 and generally designated 61'. This fairlead 61' can include a base 63'. The base 63' can be joined with one or more posts 66'. The posts can be in the form of a staple having sharpened ends 66E'. The sharpened ends 66E' can easily pierce the ankle collar sheet 74'. The ends 66E' can be bent over, generally toward one another as illustrated in FIG. 10. In turn, the ends can secure the fairlead 61' to the first portion 74' for the ankle collar in general. In this construction, no additional or secondary fastener is used. Instead, the bent over ends 66E' are crimped and directly engage the first portion to secure the fairlead in place relative to the ankle collar.

As explained above, the footwear in particular the lacing system includes an elongated lace 50. The elongated lace 50 can be in the form of a cord, a rope, a wire, a strand, a filament, a yarn, an elongated continuous piece of rawhide or leather, or some other elongated member of a sufficient length to wrap rearwardly around at least a portion of the ankle opening 11. The lace also can be sized to have a diameter that fits through the respective fairlead lace holes. Optionally, the diameter can be selected so that the lace is physically smaller than the interior diameter or dimension of the lace hole, thereby allowing the lace to slide relative to the fairlead more easily. Of course even where the diameter is the same size or slightly larger than the interior diameter or dimension of the lace hole, the lace still can slide relative to the hole and fairlead in general.

Figure 9:
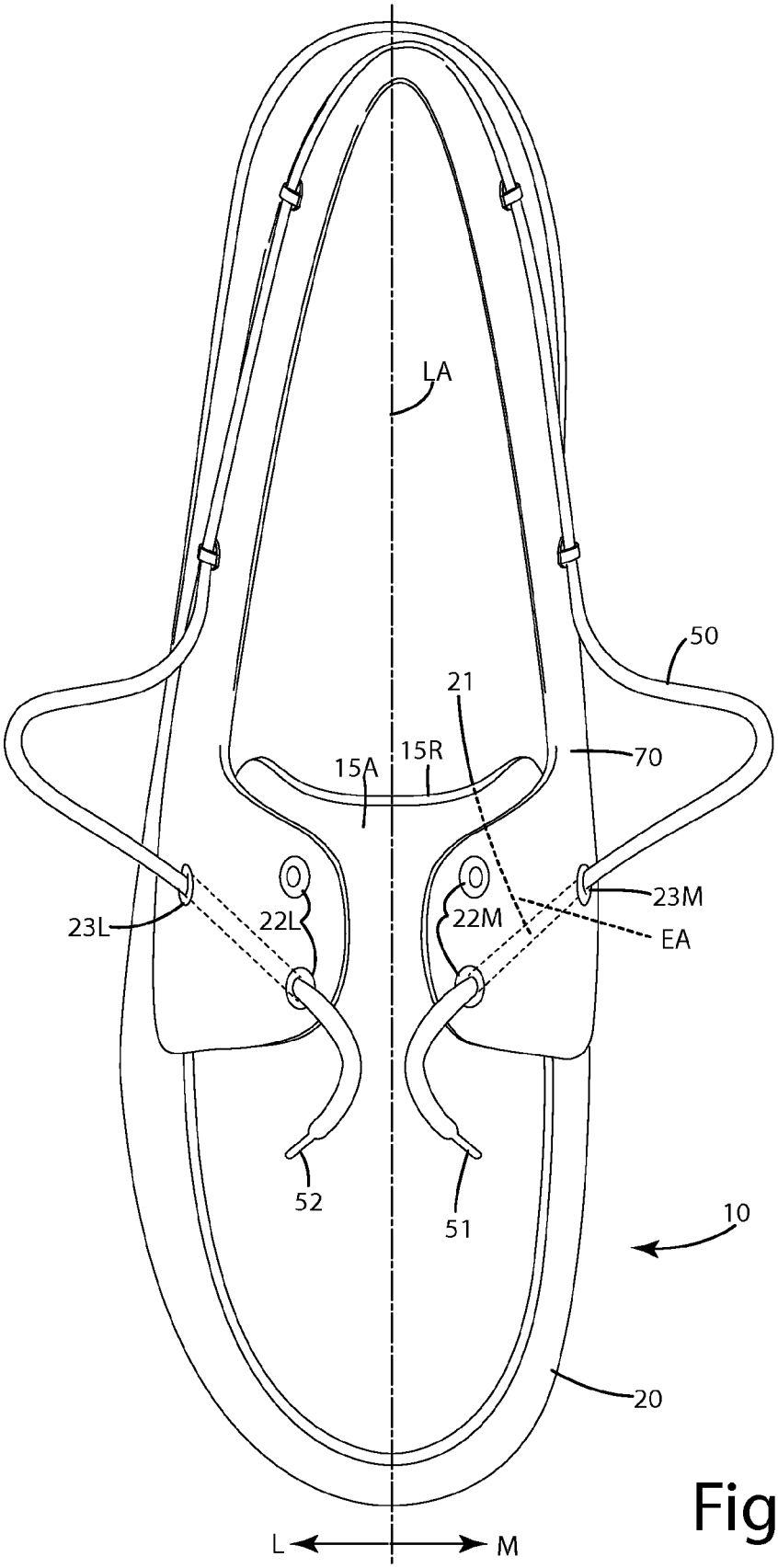
FIG. 9 is a top view of the footwear with an elongated lace being strung through lace eyelets and side eyelets on one side of the footwear, multiple fairleads, and lace eyelets inside eyelets on an opposing side of the footwear.

The lace as illustrated in FIGS. 1, 7 and 9 can include first and second ends 51 and 52. These ends 51 and 52 can be selectively disposed through the respective lace eyelets, side eyelets and fairleads, with the lace extending circuitously and continuously through the same. With the lace fully installed, the ends 51 and 52 eventually are positioned over the tongue and/or vamp of the footwear, where they may be tied relative to one another in a square knot or other knot as desired by the user.

The elongated lace extends generally from a location adjacent the tongue 15A, rearward adjacent, but entirely exterior to the ankle collar 70. The lace extends through the fairlead lace holes on the medial side M, depending on the number of fairleads, and around the heel of the wearer. From there forward, the lace extends through the fairlead lace holes on the lateral side L, depending on the number of fairleads. Optionally, the lace extends through the first fairlead 61 on the medial side and the second fairlead 62 on the lateral side of the longitudinal axis LA. The lace extends back toward a location adjacent the tongue 15A.

In addition to extending through the respective fairleads, the lace can extend exterior to the ankle collar, generally around at least a portion of the ankle collar opening 11. The lace also can extend through the respective side eyelets 23M and 23L. Where it does so, the lace can extend from an exterior of the footwear adjacent the vamp and/or tongue and into an interior 21 of the upper 10. The lace 50 can then traverse toward the lace eyelets 23M and 23L further extending through those elements. In doing so, the lace transitions from the interior of the upper, back to an exterior of the upper and into the environment.

The ends 51 and 52 of the lace can be crisscrossed and extend again through respective, additional lace eyelets 23M and 23L, transitioning back more close to the rear edge 15R of the tongue 15A. As mentioned above, the ends can be tied with one another to secure the lace to the footwear and over the instep of the wearer.

In the footwear of the current embodiments, the elongated lace can encircle the ankle the wearer 360°. The first second ends of the lace can be joinable in a knot so as to ensure the footwear is securely joined with the wearer's foot. The lace also can be slidable or movable relative to the fairleads. With the fairlead construction, the lace also can be replaceable and/or removal relative to those structures to facilitate replacement of a worn lace or customization with a special aesthetic lace.

The current embodiments also provide a method of replacing a lace in a lacing system of footwear as shown in FIG. 9. The method can generally include providing a footwear having an upper with an ankle collar and a tongue as described above. The footwear can include an outsole as described above. The ankle collar and/or upper in general can include the fairleads and eyelets as described above.

A user can manually, without the use of tools, string an elongated lace through the respective eyelets and fairleads. For example, the user can string the elongated lace from a first location adjacent the tongue and/or vamp, through a first fairlead lace hole, around a heel of the footwear, through a second fairlead lace hole, and back toward another location adjacent the tongue and/or vamp on the opposite side of longitudinal axis of the upper. The user can then lace the ends of the lace through the respective side eyelets and lace eyelets, and tie a knot to secure those ends. After the user is done, the ends are joined at the knot generally over the tongue and/or vamp to ensure the footwear is securely joined to the wearer's foot. This lacing system provides 360° securement of the lace about the ankle and/or foot of the wearer.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A footwear construction comprising:

an outsole;

an upper joined with the outsole, the upper including an ankle collar and a tongue configured to cooperatively surround an ankle of a wearer when the footwear is worn by the wearer, the ankle collar including an ankle collar rear portion extending around a heel of the wearer when the footwear is worn by a wearer;

a first fairlead extending outwardly from the ankle collar, the first fairlead including a first base, the first base engaging the ankle collar, the first base including a first body and a first fairlead post, the first body extending outwardly from the first base and defining a fairlead first lace hole, the first fairlead post extending inwardly through at least a portion of the ankle collar, the first fairlead being located closer to the ankle collar rear portion than the tongue, the first base including a first forward protuberance and a first rearward protuberance extending forward and rearward of the first lace hole, respectively, exterior to the ankle collar, the first base including the first forward protuberance and the first rearward protuberance and having a second width greater than a first width of the first body;

a second fairlead extending outwardly from the ankle collar, the second fairlead including a second base, the second base engaging the ankle collar, the second base including a second body and a second fairlead post, the second body extending outwardly from the second base and defining a fairlead second lace hole, the second fairlead post extending inwardly through at least a portion of the ankle collar, the second fairlead being located closer to the ankle collar rear portion than the tongue, the second base including a second forward protuberance and a second rearward protuberance extending forward and rearward of the first lace hole, respectively, exterior to the ankle collar, the second base including the second forward protuberance and the second rearward protuberance and having a fourth width greater than a third width of the second body;

an elongated lace including first and second ends, the elongated lace extending from a location adjacent the tongue, rearward adjacent but entirely exterior to the ankle collar, the lace extending through the fairlead first lace hole over the first forward and first rearward protuberances, and configured to extend around the heel of the wearer, the lace extending through the fairlead second lace hole, over the second forward and second rearward proturberances, back toward a location adjacent the tongue, the first base and the second base being wider than the first body and second body respectively to provide a seating surface for the elongated lace, wherein the ankle collar defines interior ankle collar cavity, wherein the first fairlead post and the second fairlead post each terminate within the interior ankle collar cavity, with respective ends of the first fairlead post and the second fairlead post being concealed within the interior ankle collar cavity, whereby the elongated lace is configured to encircle the ankle of the wearer 360°, with the first and second ends joinable at a knot so as to ensure the footwear is securely joined with the wearer's foot.

2. The footwear construction of claim 1 wherein the elongated lace remains exterior to the ankle collar as the elongated lace extends adjacent the ankle collar.

3. The footwear construction of claim 1 wherein the first fairlead is joined with a first portion forming a part of an exterior of the upper, wherein the elongated lace does not extend through the first portion around the ankle collar and remains substantially exteriorly located relative to the ankle collar.

4. The footwear construction of claim 1, wherein the upper defines a side eyelet, wherein the upper defines a lace eyelet forward of the side eyelet, wherein the elongated lace extends from the first fairlead, through the side eyelet, and into an interior of the upper, wherein the elongated lace extends to the lace eyelet in the interior of the upper, and out that lace eyelet to an exterior of the upper.

5. The footwear construction of claim 1 wherein the fairlead includes a fastener joined with an end of the first fairlead post so that a portion of the ankle collar is sandwiched between the base and the fastener to secure the first fairlead to the ankle collar.

6. The footwear construction of claim 1 comprising:

a third fairlead joined with the ankle collar forward of the first fairlead and closer to the tongue than the ankle collar rear portion; and a fourth fairlead joined with the ankle collar forward of the second fairlead and closer to the tongue than the ankle collar rear portion.

7. A footwear construction comprising:

an outsole;

an upper joined with the outsole, the upper including an upper longitudinal axis, with a medial side disposed opposite a lateral side across the longitudinal axis, the upper comprising:

a vamp;

a tongue extending rearward from the vamp;

a first side quarter extending rearward from the vamp on the medial side;

a second side quarter extending rearward from the vamp on the lateral side;

a heel portion extending around a heel of the upper, the heel portion joined with the first side quarter and the second side quarter, and adapted to wrap around a heel of the wearer;

an ankle collar first side extending toward the vamp, generally above the first side quarter on the medial side, an ankle collar rear portion extending around the heel portion, an ankle collar second side extending toward the vamp, generally above the second side quarter on the lateral side, the ankle collar second side, the ankle collar rear portion and the ankle collar first side being joined with one another to form an ankle collar, the ankle collar and tongue configured to cooperatively surround an ankle of a wearer when the footwear is worn by the wearer, the ankle collar defining an internal ankle collar cavity;

a first fairlead extending outwardly from the ankle collar above the first side quarter on the medial side, the first fairlead including a first body joined with a first base, the first base engaging the ankle collar, the first body extending outward from the first base and defining a fairlead first lace hole, the first fairlead including a first fairlead post extending inwardly from the first base and through a portion of the ankle collar;

a second fairlead extending outwardly from the ankle collar above the second side quarter on the lateral side, the second fairlead including a second body joined with a second base, the second base engaging the ankle collar, the second body extending outward from the second base and defining a fairlead second lace hole, the second fairlead including a second fairlead post extending inwardly from the second base and through another portion of the ankle collar; and an elongated lace extending from a location adjacent the tongue on the medial side, rearward adjacent the ankle collar, the lace extending through the fairlead first lace hole, above the heel portion so as to wrap rearward around the heel of the upper, the lace extending through the fairlead second lace hole back toward a location adjacent the tongue on the lateral side, the elongated lace including first and second ends, wherein the first fairlead post and the second fairlead post each terminate within the interior ankle collar cavity, with respective ends of the first fairlead post and the second fairlead post being concealed within the interior ankle collar cavity, whereby the elongated lace is configured to encircle the ankle of the wearer 360°, with the first and second ends joinable in a knot to ensure the footwear is securely joined with the wearer's foot.

8. The footwear construction of claim 7 wherein the first fairlead lace hole has a lace hole axis that is angled 0° to 25° relative to the longitudinal axis.

9. The footwear construction of claim 7 wherein the vamp includes a side eyelet and a pair of lace eyelets on the medial side, wherein the elongated lace extends through the first fairlead, through the side eyelet, and through the pair of lace eyelets.

10. The footwear construction of claim 7, wherein the ankle collar is constructed from a sheet of material folded over upon itself at a fold line, so that a first portion of the sheet faces outwardly from the longitudinal axis, and so that a second portion of the sheet faces inwardly toward the longitudinal axis, the first portion of the sheet and the second portion of the sheet defining the internal ankle collar cavity therebetween;

wherein the first base of the first fairlead engages the first portion of the sheet, but not the second portion of the sheet.

11. The footwear construction of claim 7 wherein the elongated lace remains exteriorly located relative to the ankle collar as the elongated lace traverses about an ankle opening of the footwear.

12. The footwear construction of claim 7, wherein the first fairlead post extends through an aperture defined by the ankle collar, wherein a rivet is joined with an end of the first fairlead post within the interior ankle collar cavity to secure the first fairlead to the ankle collar.

13. The footwear construction of claim 7, wherein the first fairlead and the second fairlead are constructed from at least one of a mental, a composite, a polymer and combinations thereof.

14. The footwear construction of claim 7 wherein the elongated lace is slidably disposed in the fairlead first hole and fairlead second hole so that the elongated lace can be pulled to simultaneously slide relative to the first fairlead and the second fairlead.

15. The footwear construction of claim 14, wherein the ankle collar is joined with a forward section, the forward section defining a side eyelet and a plurality of lace eyelets, wherein the elongated lace extends through the side eyelet, into an interior of the upper, and out of the interior through at least one of the plurality of lace eyelets.

16. The footwear construction of claim 7 wherein the elongated lace remains exterior to the ankle collar cavity.

17. A footwear construction comprising:

an outsole;

an upper joined with the outsole, the upper including an upper longitudinal axis, with a medial side disposed opposite a lateral side across the longitudinal axis, the upper comprising:

a vamp;

a tongue extending rearward from the vamp;

a first side quarter extending rearward from the vamp on the medial side;

a second side quarter extending rearward from the vamp on the lateral side;

a heel portion extending around a heel of the upper, the heel portion joined with the first side quarter and the second side quarter, and adapted to wrap around a heel of the wearer;

an ankle collar first side extending toward the vamp, generally above the first side quarter on the medial side, an ankle collar rear portion extending around the heel portion, an ankle collar second side extending toward the vamp, generally above the second side quarter on the lateral side, the ankle collar second side, the ankle collar rear portion and the ankle collar first side being joined with one another to form an ankle collar, the ankle collar and tongue configured to cooperatively surrounding an ankle of a wearer when the footwear is worn by the wearer;

a first fairlead extending outwardly from the ankle collar above the first side quarter on the medial side, the first fairlead including a first body joined with a first base, the first base engaging the ankle collar, the first body extending outward from the first base and defining a fairlead first lace hole;

a second fairlead extending outwardly from the ankle collar above the second side quarter on the lateral side, the second fairlead including a second body joined with a second base, the second base engaging the ankle collar, the second body extending outward from the second base and defining a fairlead second lace hole; and an elongated lace extending from a location adjacent the tongue on the medial side, rearward adjacent the ankle collar, the lace extending through the fairlead first lace hole, above the heel portion so as to wrap rearward around the heel of the wearer, the lace extending through the fairlead second lace hole back toward a location adjacent the tongue on the lateral side, the elongated lace including first and second ends, whereby the elongated lace is configured to encircle the ankle of the wearer 360°, with the first and second ends joinable in a knot to ensure the footwear is configured to securely join with the wearer's foot, wherein the ankle collar is constructed from a sheet of material folded over upon itself at a fold line, so that a first portion of the sheet faces outwardly from the longitudinal axis, and so that a second portion of the sheet faces inwardly toward the longitudinal axis, the first portion of the sheet and the second portion of the sheet defining an ankle collar cavity therebetween;

wherein the first base of the first fairlead engages the first portion of the sheet, but not the second portion of the sheet, wherein the first fairlead includes a first fairlead post extending from the base in a direction opposite the first body;

wherein the first fairlead post extends through an aperture defined by the first portion of the sheet, with a first end of the first fairlead post projecting into the ankle collar cavity.

18. The footwear construction of claim 17, wherein a fastener is secured to the first end to anchor the first fairlead to the first portion of the sheet.

* * * * *